US008375930B2

(12) United States Patent
Gore

(10) Patent No.: US 8,375,930 B2
(45) Date of Patent: Feb. 19, 2013

(54) AIR GUN VIBRATION DAMPENER AND METHOD

(76) Inventor: Thomas Gore, South Lyon, MI (US)

( * ) Notice: Subject to any disclaimer, the term of this patent is extended or adjusted under 35 U.S.C. 154(b) by 349 days.

(21) Appl. No.: 12/618,301

(22) Filed: Nov. 13, 2009

(65) Prior Publication Data

US 2010/0059033 A1 Mar. 11, 2010

Related U.S. Application Data

(63) Continuation-in-part of application No. 11/770,100, filed on Jun. 28, 2007, now abandoned.

(60) Provisional application No. 60/807,859, filed on Jul. 20, 2006.

(51) Int. Cl.
*F41B 11/00* (2006.01)

(52) U.S. Cl. ..... 124/66; 124/64; 124/65; 124/68

(58) Field of Classification Search ..... 42/1.06; 124/66, 67, 68, 64, 65
See application file for complete search history.

(56) References Cited

U.S. PATENT DOCUMENTS

| | | | | |
|---|---|---|---|---|
| 3,090,151 | A | 5/1963 | Stewart et al. | |
| 4,388,855 | A | 6/1983 | Sokolovsky | |
| 4,736,931 | A * | 4/1988 | Christopherson | 267/34 |
| 4,848,307 | A | 7/1989 | Tsao | |
| 4,850,329 | A | 7/1989 | Taylor et al. | |
| 5,261,384 | A | 11/1993 | Hu | |
| 5,377,655 | A | 1/1995 | Arad | |
| 5,570,676 | A * | 11/1996 | Gore | 124/56 |
| 6,250,294 | B1 * | 6/2001 | Lim | 124/66 |
| 7,597,096 | B2 * | 10/2009 | Gan | 124/77 |

* cited by examiner

*Primary Examiner* — Daniel J Troy
(74) *Attorney, Agent, or Firm* — Quinn Law Group, PLLC

(57) ABSTRACT

A vibration dampening system for an air gun charging system includes a rear guide tube and a forward guide tube that are received within opposite ends of an air gun power spring, and a sleeve that fits concentrically over the power spring. The rear guide tube and the sleeve cooperate to reduce the free length of the power spring allowed to vibrate, which reduces vibration and improves firing performance.

5 Claims, 7 Drawing Sheets

AIR GUN VIBRATION DAMPENER AND METHOD

CROSS-REFERENCE TO RELATED APPLICATIONS

This application is a Continuation In part of U.S. patent Ser. No. 11/770,100, filed on Jun. 28, 2007 now abandoned, which claims the benefit if U.S. Provisional Patent Application Ser. No. 60/807,859, filed Jul. 20, 2006, the disclosure of which is hereby incorporated by reference.

TECHNICAL FIELD

The invention generally relates to air guns, and more particularly relates to a dampening system for reducing vibration in a charging assembly of an air gun.

BACKGROUND OF THE INVENTION

Although there are several types of systems for powering air guns, most air guns are powered by a power spring, e.g., a coil spring. The power spring actuates a hollow piston that covers or "skirts" the power spring. The piston includes a sear that engages a latch that is connected to a trigger assembly of the air gun.

Generally, in air guns that incorporate a contained power spring energy source, cocking the power spring, i.e., compressing the power spring creates a quantity of stored energy that can be released when desired by means of the trigger assembly to fire the air gun. When fired, the compressed power spring expands, moving the piston forward with in a compression tube to compress a quantity of air, which then launches a projectile.

These spring-powered air guns suffer from inaccuracy due to the hysteresis, vibration, and other harmonics resulting from the rapid unloading, decompression, or uncoiling of the power spring when fired.

There exist air-gunsmiths or "tuners" that offer special air gun charging system improvements claiming better performance to users that want more power and/or accuracy from their air guns. One of the primary benefits of tuning air guns is to reduce vibration when the power spring is released and the air gun is fired.

Some charging system improvements simply replace the entire original charging system with custom-fit components to reduce vibration. Others include modifying the charging system by adding nylon buttons to the outside surface of the piston tube itself to eliminate vibrations. While these prior art techniques for increasing air gun performance may achieve effective results for their intended purpose, they require significant modification to the air gun components and/or the replacement of most, if not the entire, charging system.

Referring now to Prior Art FIGS. 1 and 2, the general operation of a power spring charging system 1 of an air gun is described. The charging system 1 is illustrated in a cocked or ready-to-fire position in FIG. 1. Once a trigger 2 is pulled, a skirted piston 3 in the air gun compresses the air within an area 4 in a chamber of a compression tube 5 with a given force provided by a helical power spring 6 behind the head 7 of the piston 3. A dynamic seal or gasket 8 creates an air-tight seal between the piston 3 and an inner surface of the compression tube 5. A small washer-like guide member 9 has a rearward end that fits partially within the coils of the power spring 6 and a forward shoulder fits within the piston 3.

A rear guide tube 12 guides the power spring 6 at the rearward end of the charging system 1, and allows a sear rod 10 of the piston 3 to selectively engage a trigger assembly. A rearward shoulder 13 of the rear guide tube 12 provides a surface for the power spring 6 to press against, while an internal through bore 14 of the rear guide tube 12 allows the sear rod 10 to pass therethrough. All of these components, except the trigger assembly 11 are usually placed within a receiver tube 15 of the air gun.

The piston 3 is referred to as "skirted" as it includes a cylindrical tube or skirt 16 that extends back from the head 7 of the piston 3. The skirt 16 is concentric with the sear rod 10. The piston 3 is disposed within the cylindrical compression tube 5, and defines a compression chamber 4 between the head 7 and the compression tube 5. Compression tube 5 is disposed within the receiver tube 15 at the forward end of the receiver tube 15.

One inherent aspect of current air guns using coil spring charging systems is that when the power spring 6 is loaded, i.e., compressed, during cocking, the power spring 6 expands radially (i.e., its diameter increases). When the air gun is fired the power spring 6 fires forward and contracts radially back to it unloaded size. One disadvantage of current air guns is that this radial expansion and contraction of the power spring 6 during use necessitates that there is clearance between the inner wall of the skirt 16 of the piston 3 and the unloaded power spring 6. This clearance, however, allows forward movement and uncoiling of the power spring 6 during firing, which produces vibration both during and immediately after firing has occurred and the piston has come to a rapid stop. These vibrations are due, in part, to the power spring 6, which exhibits the characteristics of unwinding, torqueing and kinetic energy as it is released from its compressed state upon firing. This vibration or oscillation of the power spring 6, both during and immediately after firing, both reduce the power supplied by the power spring 6 and reduce accuracy of the air gun. Generally, the longer the power spring 6, the greater the amplitude of the vibrating deflection of the power spring 6. This deflection is greatest at the longitudinal midpoint of the power spring 6.

SUMMARY OF THE INVENTION

A charging assembly for an air gun is disclosed. The charging assembly includes a compression tube, and a piston having a head slideably disposed within the compression tube. The piston includes a skirt, which extends from the head. The piston is configured for movement from a rearward position to a forward position to compress a gas within the compression tube. The charging assembly further includes a power spring. The power spring includes a forward end and a rearward end. The forward end is disposed adjacent the head of the piston. The power spring is configured for movement from a compressed position to an uncompressed position to move the piston from the rearward position into the forward position. The charging system further includes a dampening system. The dampening system reduces vibration of the power spring in response to the movement of the power spring from the compressed position into the uncompressed position. The dampening system includes a rear guide tube at least partially disposed within an inner diameter of the power spring. The dampening system further includes a sleeve. The sleeve defines a bore with the rearward end of the power spring disposed within the bore of the sleeve. The sleeve and the rear guide tube support at least a portion of the power spring therebetween for reducing a length of the power spring free to oscillate to limit vibration of the power spring.

In another aspect of the invention, a power spring assembly for moving a piston within a compression tube of an air gun is disclosed. The power spring assembly includes a power spring, which extends along a longitudinal axis and defines a hollow core. The power spring is moveable from a compressed position into an uncompressed position when fired. The power spring assembly further includes a dampening system. The dampening system includes a rear guide tube at least partially disposed within the hollow core of the power spring. The rear guide tube is stationary relative to the movement of the power spring. The dampening system further includes a sleeve. The sleeve defines a bore, and is coupled to the rear guide tube. The rear guide tube is disposed within the bore, and cooperates with the sleeve to define an annular gap between the rear guide tube and the sleeve. The sleeve is positionally fixed relative to the rear guide tube, and is stationary with the rear guide tube relative to the movement of the power spring. A rearward end of the power spring is disposed within the annular gap. The rear guide tube and the sleeve cooperate to radially support a portion of the power spring to limit radial movement of the power spring along the portion to reduce vibration of the power spring when moved from the compressed position into the uncompressed position.

In another aspect of the invention, a dampening system for reducing vibration in a power spring of an air gun is disclosed. The dampening system includes a rear guide tube configured for radially supporting an inner diameter of the power spring. The dampening system further includes a sleeve defining a bore and coupled to and at least partially surrounding the rear guide tube. The rear guide tube is disposed within the bore. The sleeve is configured for radially constraining an outer diameter of the power spring. The sleeve and the rear guide tube are configured for supporting at least a portion of the power spring therebetween for reducing a length of the power spring that is free to oscillate to limit vibration of the power spring when fired.

Accordingly, the dampening system disclosed encapsulates a portion of the power spring between the rear guide tube and the sleeve to radially support the power spring when fired. Radially supporting the power spring stiffens the resistance of the power spring to oscillate, thereby reducing oscillation and/or vibration in the power spring when fired.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Prior Art

Prior Art

Prior Art

DESCRIPTION OF THE PREFERRED EMBODIMENTS

Figure 1:
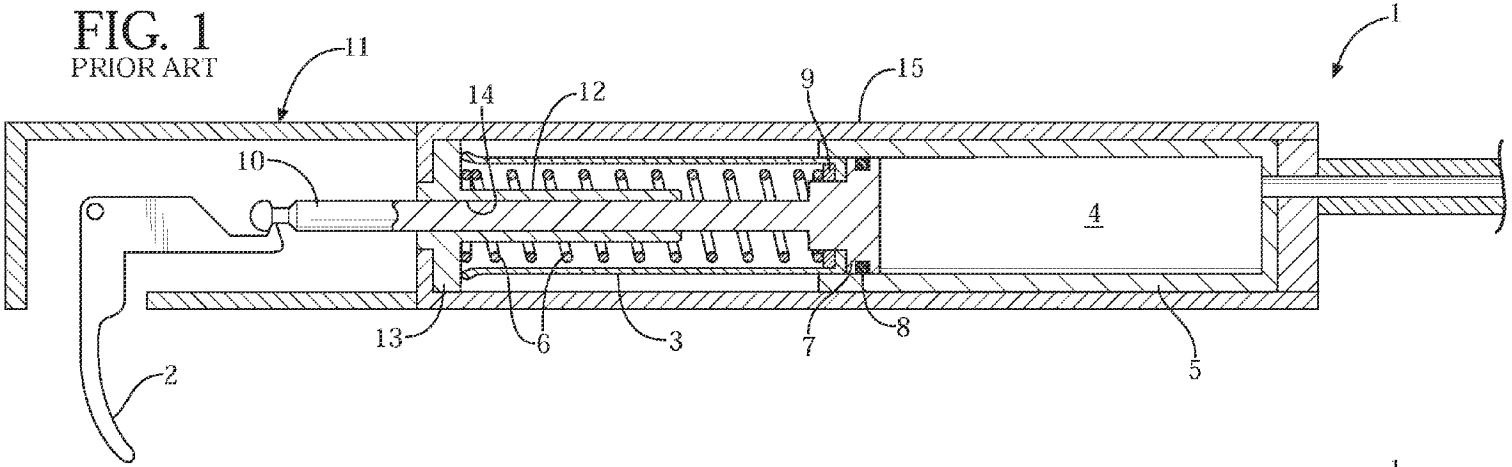
FIG. 1 PRIOR ART
FIG. 1 is a schematic side sectional view of a coil spring charging assembly.
Figure 2:
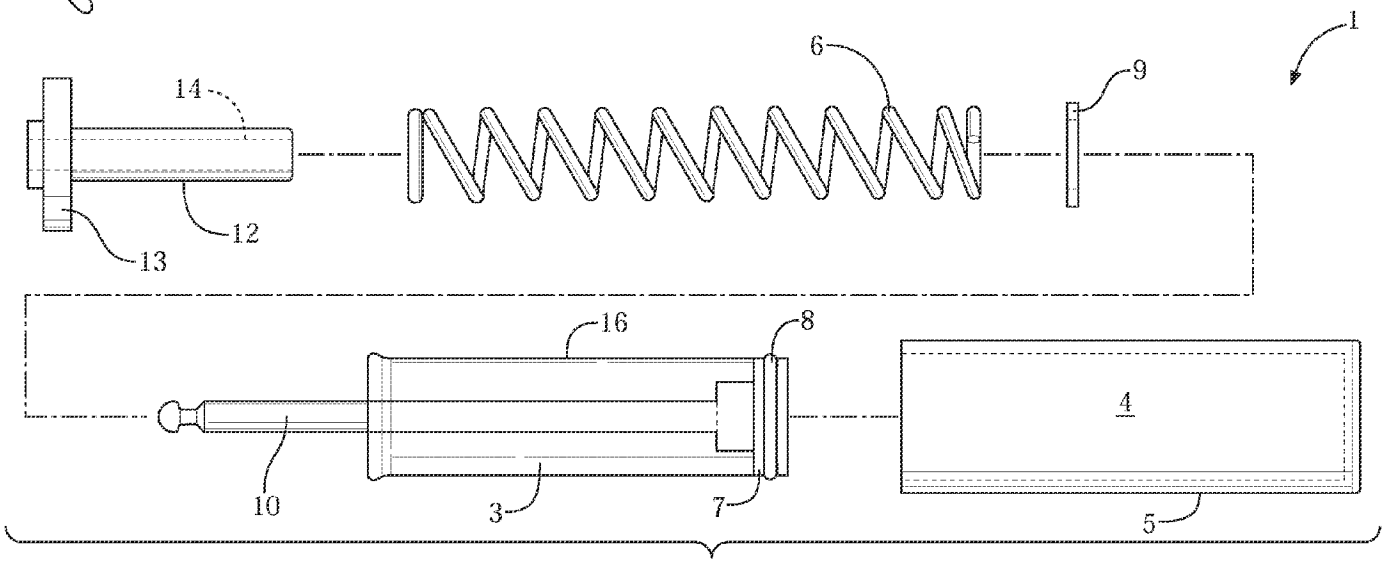
FIG. 2 PRIOR ART
FIG. 2 is a partially exploded schematic view of the coil spring charging assembly of FIG. 1.
Figure 3:
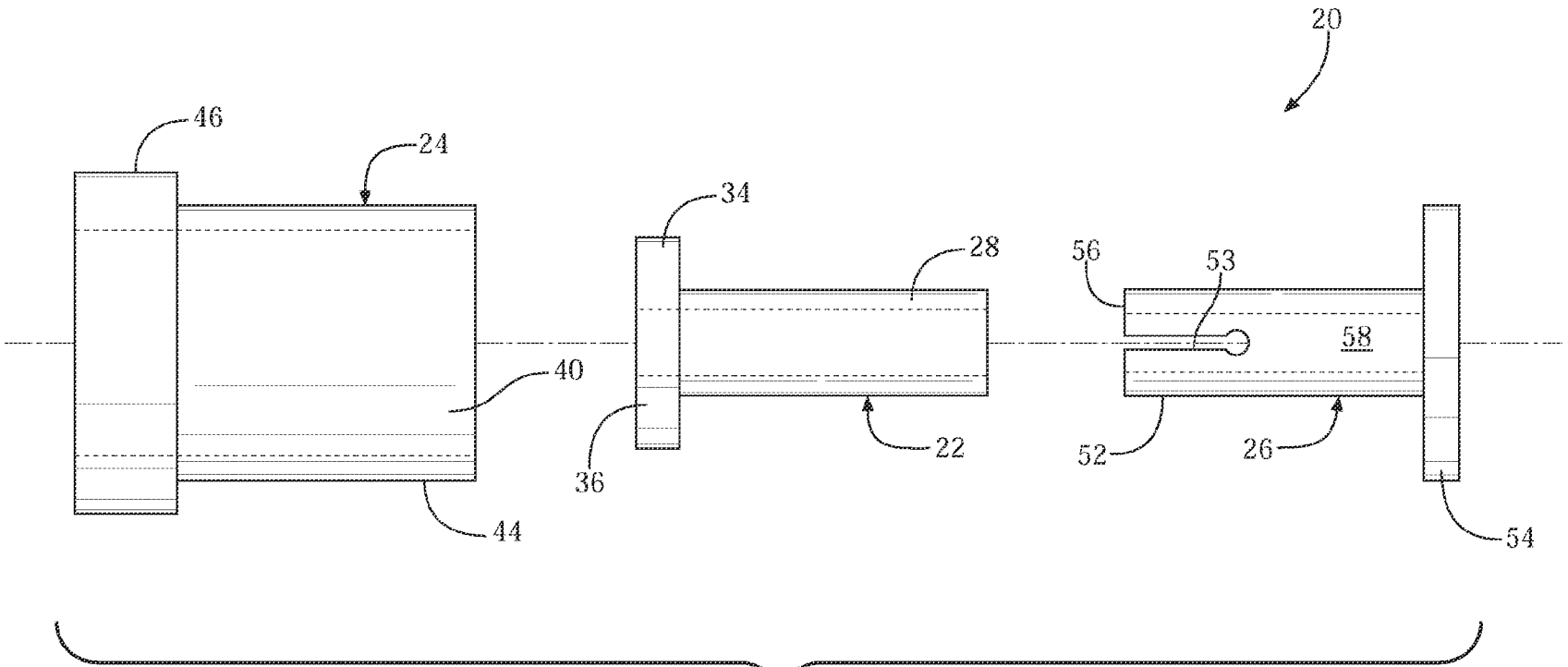
FIG. 3 is a schematic side view of a dampening system for a coil spring charging system.

Referring to FIG. 3, an air gun dampening system is shown generally at 20. The dampening system 20 includes a rear guide tube 22, a sleeve 24 and a forward guide tube 26. The dampening system 20 reduces vibration in a coil spring charging assembly shown generally at 1 in FIGS. 4 and 6.

Figure 4:
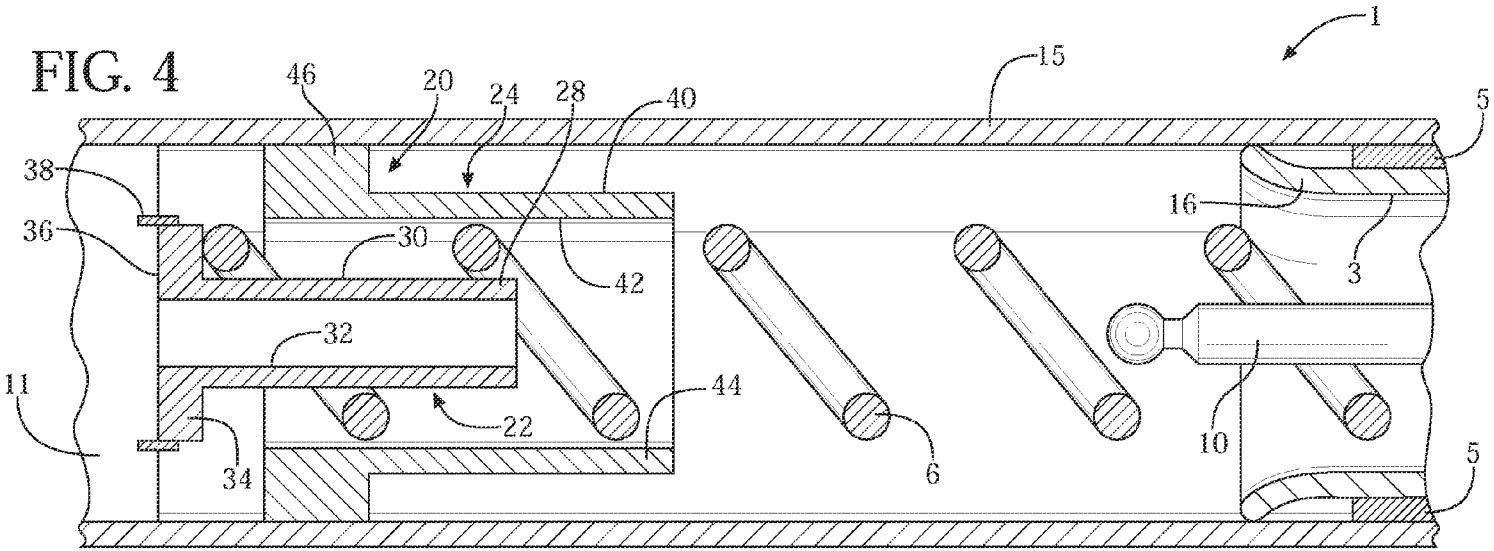
FIG. 4 is a schematic side sectional view of a sleeve and a rear guide tube in a post-firing relationship, i.e., uncompressed, within a receiving tube of an air gun.
Figure 5:
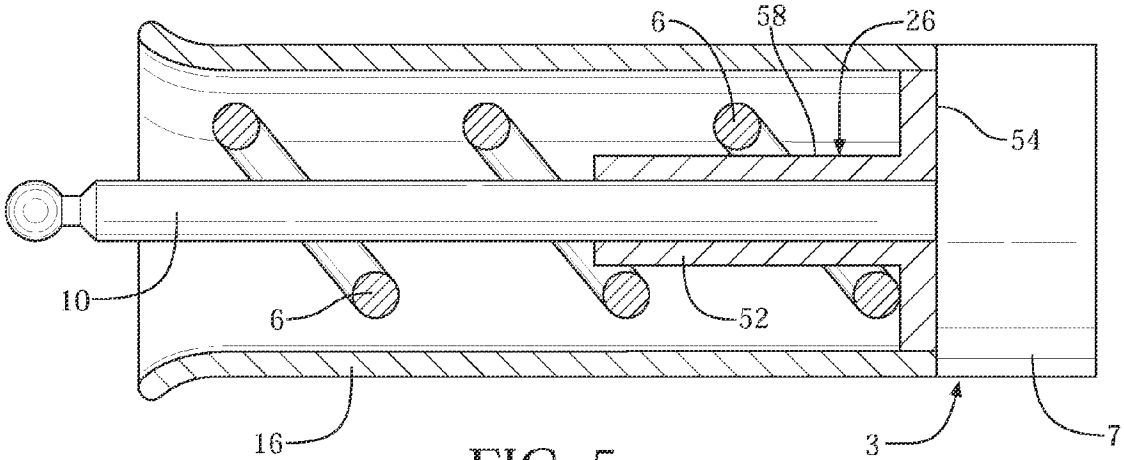
FIG. 5 is a schematic side sectional view of a front guide tube in a post-firing relationship with a power spring and a piston within the receiving tube of the air gun.
Figure 6:
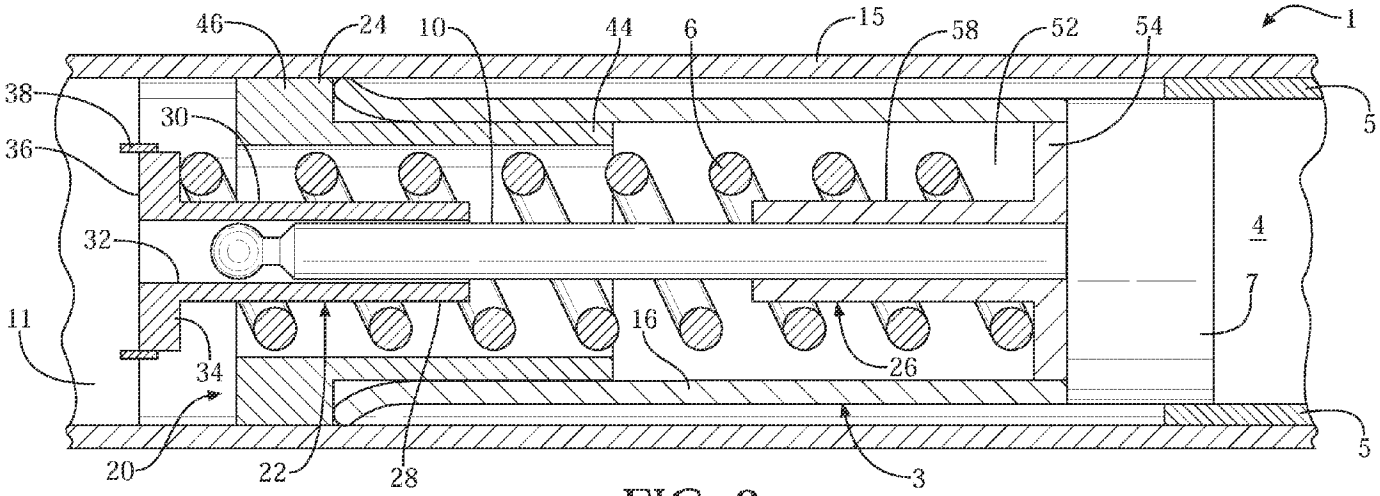
FIG. 6 is a schematic side sectional view of the dampening system in the coil spring charging system in a cocked position, i.e., a compressed position.

Referring also to FIGS. 4 -6, the charging system 1 is shown disposed within a receiving tube 15 of an air gun, and includes a compression tube 5 and a piston 3 at least partially disposed within the compression tube 5. The piston 3 includes a head 7 and a skirt 16, which extends from the head 7. The piston 3 is configured for movement from a rearward position to a forward position when the air gun is fired to compress a gas, such as air, within a chamber 4 of the compression tube 5.

The charging system 1 further includes a power spring 6. The power spring 6 includes a coil spring having a forward end and a rearward end. The forward end is disposed adjacent the head 7 of the piston 3, within the compression tube 5. The power spring 6 is configured for movement from a compressed position, i.e., a cocked and ready to fire position, into an uncompressed position, i.e., an after firing position. Movement of the power spring 6 from the compressed position into the uncompressed position moves the piston 3 from the rearward position into the forward position. The dampening system 20 reduces vibration of the power spring 6 in response to the movement of the power spring 6 from the compressed position into the uncompressed position.

The rear guide tube 22 includes an elongated tubular guide rod 28. An outer surface 30 of the guide rod 28 is smooth and wear resistant and has a diameter that allows the guide rod 28 to fit concentrically within an interior diameter of the power spring 6. The guide rod 28 defines a sear-receiving bore 32, which passes through the longitudinal center of the rear guide tube 22. The sear-receiving bore 32 includes an inner diameter sized to slideably receive a sear rod 10 of piston 3.

The rear guide tube 22 includes a rearward shoulder 34, which abuts and extends from a rearward end of the guide rod 28. When assembled into an air gun, a rear wall 36 of the shoulder 34 abuts a trigger assembly 11. As best shown in FIG. 4, the shoulder 34 is shaped complementary to and sized to fit within a forward-facing annular ring 38 found in most conventional trigger assemblies. By fitting within the ring 38, the shoulder 34 is radially contained (i.e., prevented from deflecting in the radially outward direction).

The shoulder 34 has an outer diameter that is approximately the same size or slightly smaller than the nominal, i.e., uncompressed, diameter of the power spring 6. As will be discussed in greater detail below, this reduced diameter of the shoulder 34 permits the sleeve 24 to move relative to the power spring 6 and/or the piston 3, i.e., to longitudinally traverse the power spring 6 to abut the trigger assembly 11.

The sleeve 24 has a generally tubular body 40, which defines a cylindrical bore 42. The bore 42 runs the length of the sleeve 24. The bore 42 has an inner diameter that is sized to receivably fit over the power spring 6. The rearward end of the power spring 6 is disposed within the bore 42 of the sleeve 24. The sleeve 24 and the rear guide tube 22 support at least a portion of the power spring 6 therebetween. By supporting a portion of the length of the power spring 6 between the sleeve 24 and the rear guide tube 22, a free length of the power spring 6, which is free to oscillate when fired, is reduced. Reducing the free length of the power spring 6 stiffens the power spring 6 and limits vibration and/or oscillation of the power spring 6. The bore 42 is approximately the same diameter as the outer diameter of the power spring 6 when compressed. It should be appreciated that the outer diameter of the power spring 6 is smallest when it is in its unloaded state, i.e., uncompressed, and largest when fully cocked or loaded, i.e., compressed.

As shown in FIG. 6, a front portion 44 of the body 40 is sized to be received within the skirt 16 of the piston 3 when the air rifle is cocked (i.e., when piston 3 is brought back toward guide tube 22 and sleeve 24 into the rearward position). The front portion 44 is therefore disposed concentrically between the power spring 6 and the skirt 16 when the air rifle is cocked.

The sleeve 24 also has an enlarged outer shoulder 46 that projects radially from the rearward outer surface of the sleeve 24. The shoulder 46 extends from a rearward end of the sleeve 24 and is sized to slidably engage an inner wall of a receiver tube 15 of the air gun while the rest of the sleeve body 40 remains remote from the walls of the receiver tube 15. That is, shoulder 46 is sized approximately equal to a complementary conventional air gun receiver tube 15 and preferably forms a slip-fit relationship with the receiver tube 15. Shoulder 46 runs approximately ¼ to ½ the length of the sleeve 24, ensuring that a large surface area is presented to the inner walls of the receiver tube 15, thereby preventing the sleeve 24 from angling or canting away from its desired position, i.e., parallel to the barrel of the air gun.

In operation, the sleeve 24 is mounted concentrically around the rearward end of the power spring 6 and guide tube 22. As shown in FIGS. 4 and 6, the sleeve 24 is free to slide along and to rotate about the power spring 6. Alternatively, the sleeve 24 may be positionally fixed relative to the rear guide tube 22, and restrained from moving with the power spring 6 and the piston 3.

Sleeve 24 may be formed from a rigid, dense, and wear-resistant material such as steel when configured to slide along and to rotate about the power spring 6. A material such as steel provides sufficient weight to the sleeve 24 for the inertia of the freely sliding sleeve 24 to counter the shock exerted upon the air rifle by the power spring 6 and piston head 7 slamming into (and bouncing back from) the forward end of compression tube 5. Alternatively, if the sleeve 24 is configured to remain stationary relative to the rear guide tube 22 and not move with the piston 3 and the power spring 6, then the sleeve 24 may be formed from a compliant, energy absorbing material, such as a plastic, to absorb and reduce vibration.

Figure 7:
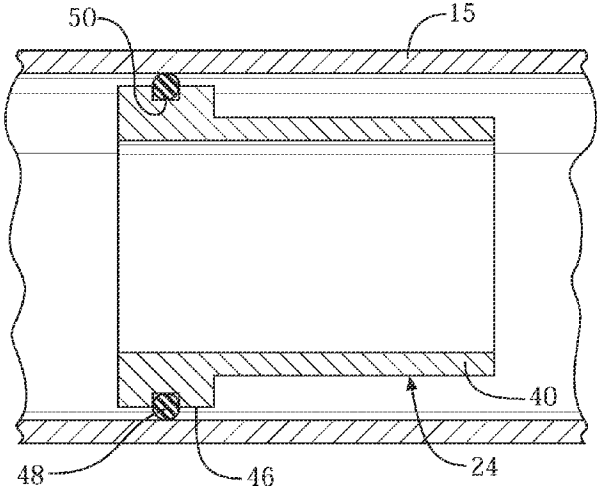
FIG. 7 is a schematic side sectional view of an alternate embodiment of the sleeve.

In one alternate embodiment, shown in FIG. 7, at least one compressible or compliant member 48, such as an o-ring, is disposed concentrically around the shoulder 46. The compliant member 48 fits partially within and extends from a channel 50 around a circumference of the shoulder 46. The compliant member 48 slides along an inner wall of the receiver tube 15, and allows for machining differences or irregularities within and along the receiver tube 15. The compliant member 48 is preferably formed from an elastomeric material which further dampens any vibration.

Referring to FIGS. 3, 5, and 6, the dampening system 20 also includes a forward guide tube 26. The forward guide tube 26 is similar in construction to the rear guide tube 22, but is oriented such that an elongated body 52 of the forward guide tube 26 faces rearward, while a shoulder 54 of the forward guide tube 26 abuts the head 7 of the piston 3. As best shown in FIG. 5, the forward guide tube 26 is placed within the forward end of the power spring 6, which in-turn, is placed within the skirt 16 of the piston 3.

The forward guide tube 26 further differs from the rear guide tube 22 as it has an inner bore diameter that is approximately the same as or slightly smaller than the diameter of the sear rod 10. A slot 53 is formed in the tubular body 52 from a rearward edge 56 of the body 52, and runs approximately one-fifth to one one-third the length of the body 52. The slot 53 allows the body 52 to expand slightly around the sear rod 10 to frictionally couple the forward guide tube 26 to the piston 3.

Further, the outer diameter of tubular body 52 of the forward guide tube 26 is sized to be slightly smaller than the nominal (unloaded or post-firing) inner diameter of the power spring 6. In this manner, an outer surface 58 of the body 52 abuts an inner diameter of the power spring 6, and thereby absorbs any vibrations therein.

In addition to absorbing vibrations within the power spring 6 during and after firing, the dampening system 20 also is effective in reducing the overall spring oscillation by stiffening the beam of the power spring 6 (i.e., by effectively shortening the length of the power spring 6 that is free to oscillate within the air rifle). When a spring powered air gun is fired, the power spring 6 not only presses forward against the piston 3, but also oscillates or vibrates, which reduces performance. The power spring 6 continues to vibrate after it has been fired (i.e., after the power spring 6 has been unloaded) as the piston 3 and the power spring 6 come to a rapid stop at the forward end of the compression tube 5.

Figure 8:
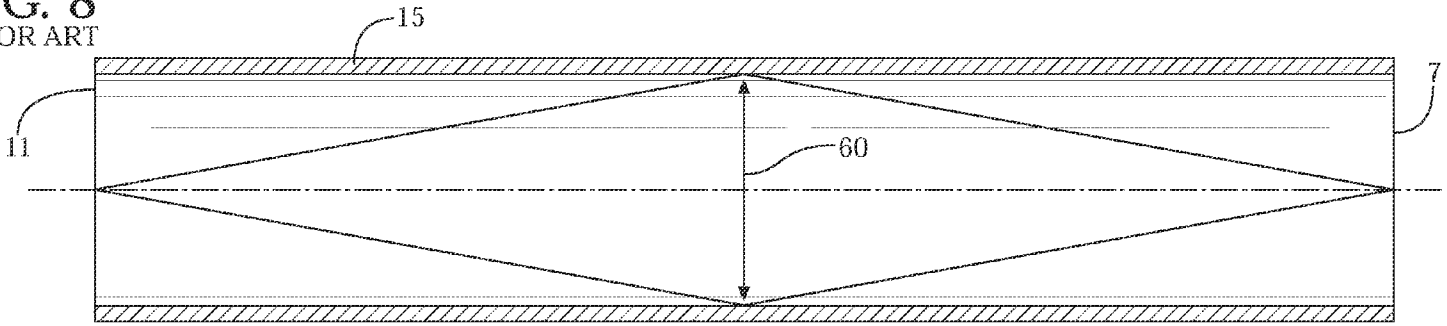
FIG. 8 PRIOR ART
FIG. 8 is a diagram showing the oscillation of the coil spring charging assembly's power spring.
Figure 9:
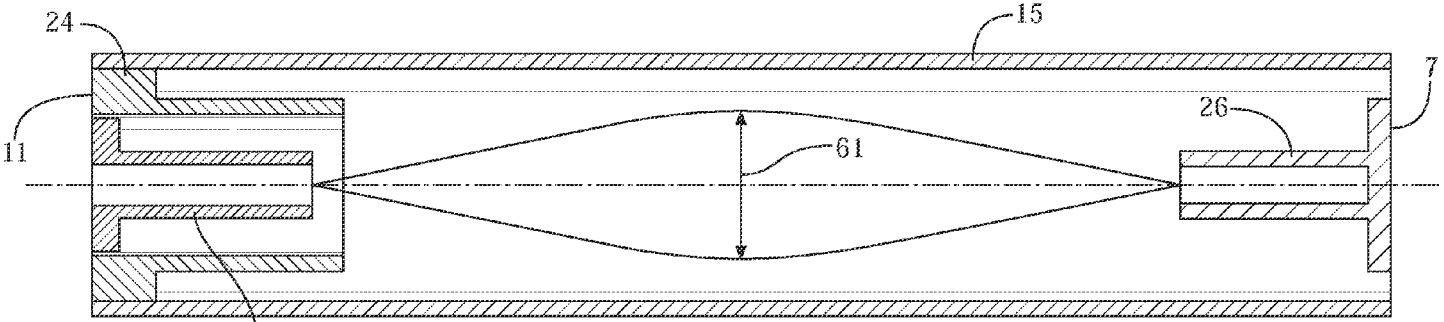
FIG. 9 is a diagram showing the reduced amplitude of the oscillations of the coil spring charging assembly's power spring in combination with the dampening system disclosed herein.

In operation, the sleeve 24, the rear guide tube 22 and the forward guide tube 26 cooperate to reduce the length of the power spring 6 that is free to oscillate within the receiver tube 15 after firing. Referring to Prior Art FIG. 8, arrow 60 denotes a relatively large amplitude of oscillation present in the prior art coil spring charging system 1, where the entire length of the substantially unrestricted power spring 6 is free to oscillate after firing. Referring to FIG. 9, the effects of the dampening system 20 on the oscillation of the power spring 6 are shown. The dampening system 20 reduces the free length of the power spring 6 that is free to oscillate after firing, inherently reducing the amplitude of the oscillations, shown by arrow 61.

Figure 10:
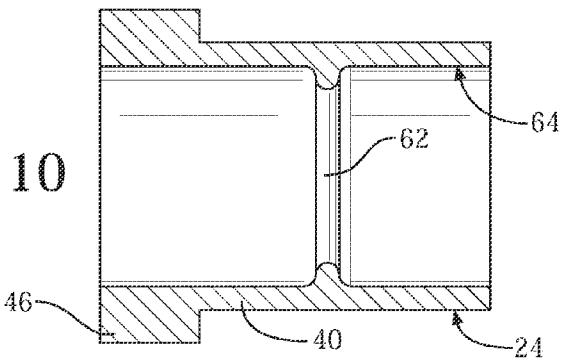
FIG. 10 is a schematic side sectional view of another alternate embodiment of the sleeve.

In one non-limiting embodiment, shown in FIG. 10, the sleeve 24 includes at least one ring or bumper 62 that projects radially inwardly around the diameter of the sleeve 24. The bumper 62 is preferably a contiguous annular shoulder rolled into the sleeve 24 around the circumference of the tubular sleeve 24.

In other embodiments, more than one bumper 62 may be formed around the sleeve 24. Further, the bumper 62 is not limited to the circular shape illustrated and may take substantially any shape or configuration which results in an inner surface 64 of the sleeve 24 partially extending inwardly toward a center of the sleeve 24. In still other embodiments, the bumper 62 is not contiguous with the sleeve 24 and is instead a separate button or washer fixed to the inner surface 64 of the sleeve 24 by conventional means.

As shown, the bumper 62 has an arcuate shape which allows for the individual coils of the power spring 6 to abut the bumper 62 while preventing the dampening bumper 62 from snagging on the spring 6.

Figure 11:
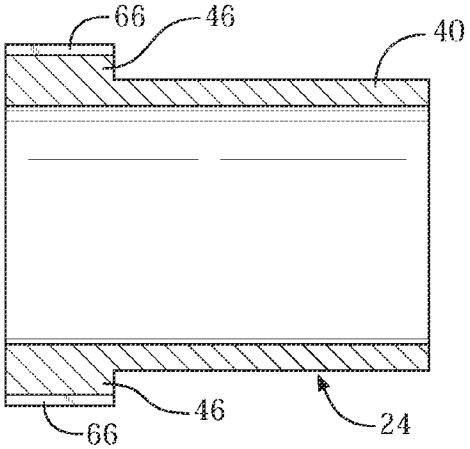
FIG. 11 is a schematic side sectional view of another alternate embodiment of the sleeve.

Referring now to FIG. 11, an alternate embodiment of the sleeve 24 is shown having a layer 66 of elastomeric material coating the outer surface of the shoulder 46 of the sleeve 24. In the preferred version of this embodiment, the layer 66 is sprayed onto the sleeve 24 as a liquid and allowed to set to form the layer 66. In operation, the layer 66 on the sleeve 24 abuts both the inner wall of the receiver tube 15 and the inner wall of skirt 16 of the piston 3 to absorb any vibrations during use.

Figure 12:
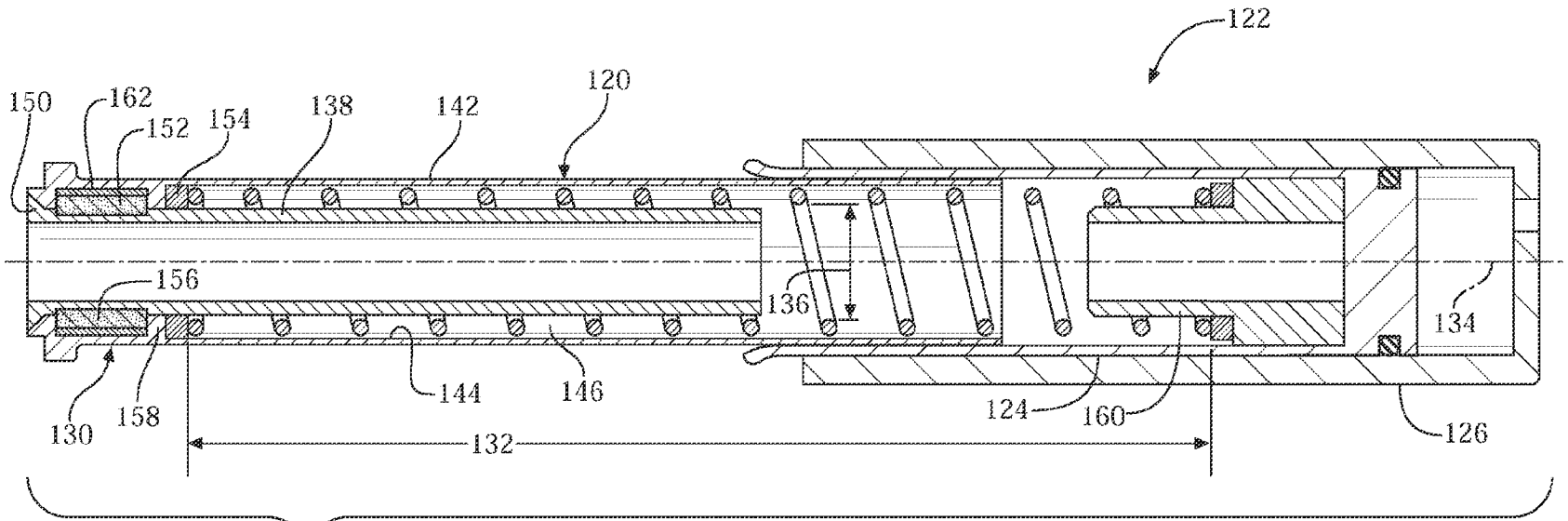
FIG. 12 is a schematic cross sectional view of an alternative embodiment of the charging assembly.

Referring to FIG. 12, a power spring assembly is shown generally at 120. The power spring assembly is for a charging system, shown generally at 122, of an air gun. More specifically, the power spring assembly 120 moves a piston 124 of the charging assembly within a compression tube 126 of the air gun.

Figure 13:
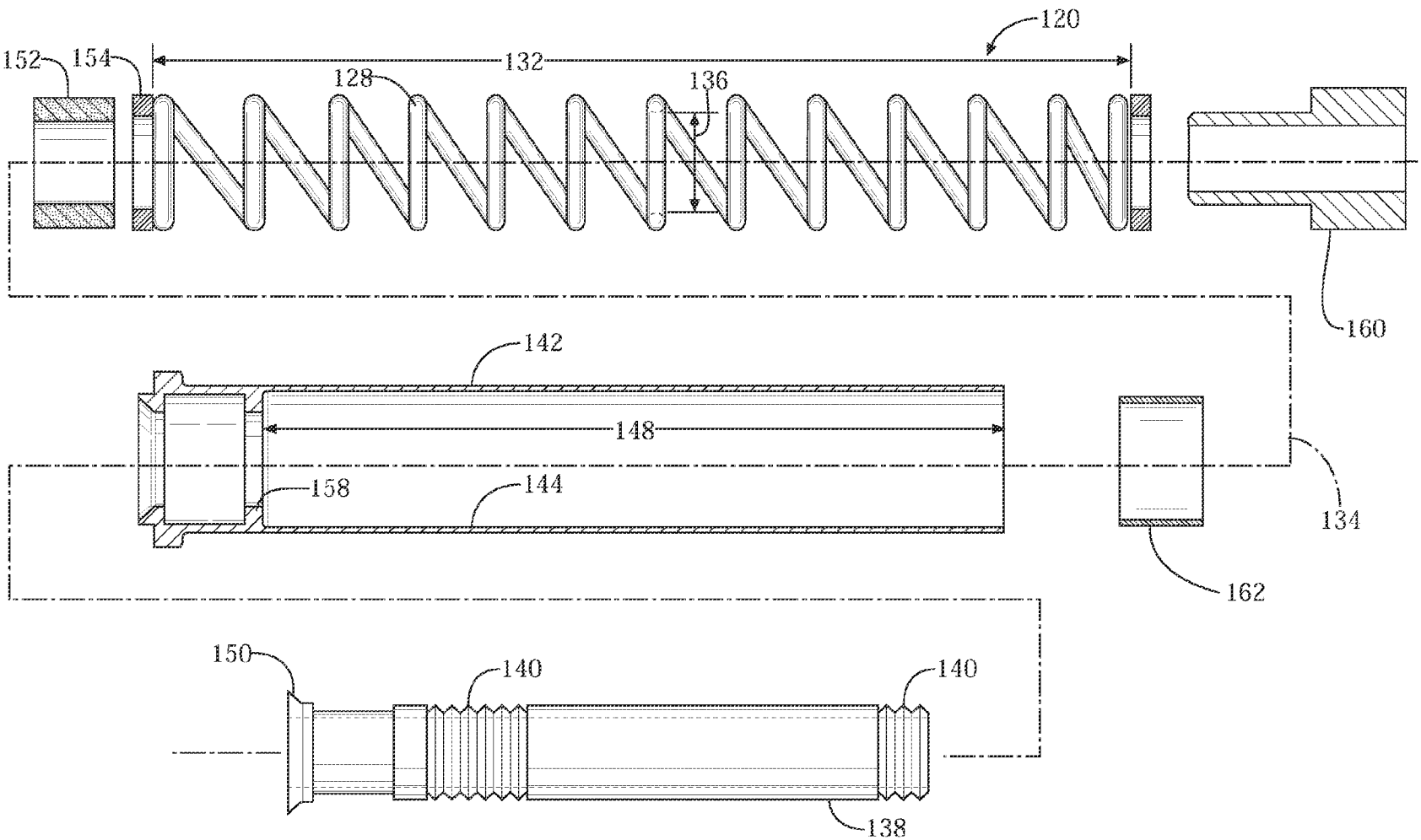
FIG. 13 is a schematic exploded cross sectional view of a power spring assembly of the alternative embodiment of the charging assembly shown in FIG. 12.

Referring also to FIG. 13, the power spring assembly 120 includes a power spring 128 and a dampening system 130. The power spring 128 includes an uncompressed spring length 132 that extends along a longitudinal axis 134. The uncompressed spring length 132 may vary to provide variable levels of force. The power spring 128 extends along the longitudinal axis 134, and defines a hollow core 136. The power spring 128 is moveable from a compressed position, wherein the spring includes a compressed length along the longitudinal axis 134, into an uncompressed position when fired, wherein the spring includes the uncompressed spring length 132. Preferably, the spring includes a coil spring, with the inner diameter of the coils defining the hollow core 136.

The dampening system 130 includes a rear guide tube 138, which is at least partially disposed within the hollow core 136 of the power spring 128. The rear guide tube 138 is stationary relative to the movement of the power spring 128, i.e., the power spring 128 moves relative to the rear guide tube 138 during compression and/or expansion of the power spring 128. Preferably, the rear guide tube 138 includes an outer diameter that is approximately 10 thousandths of an inch smaller than the hollow core 136, i.e., inner diameter, of the power spring 128. The smaller diameter of the rear guide tube 138 minimizes friction between the rear guide tube 138 and the power spring 128 when fired.

The rear guide tube 138 may include at least one surface depression 140 disposed on an outer surface of the rear guide tube 138. The surface depression 140 collects a lubricant, e.g., a grease, from the power spring 128 and/or deposits the lubricant on the power spring 128 during the movement of the power spring 128 between the compressed position and the uncompressed position. The surface depression 140 provides a pocket for storing the lubricant, and prevents the power spring 128 from scraping the lubricant off the outer surface of the rear guide tube 138 during movement. As shown, the surface depression 140 includes a plurality of annular concave depressions disposed axially along the longitudinal axis 134. However, it should be appreciated that the surface depression 140 may include some other shape and configuration not shown or described herein that is capable of storing the lubricant on the outer surface of the rear guide tube 138.

The dampening system 130 further includes a sleeve 142. The sleeve 142 defines a bore 144, and is coupled to the rear guide tube 138. The rear guide tube 138 is disposed within the bore 144. The rear guide tube 138 cooperates with the sleeve 142 to define an annular gap 146 between the rear guide tube 138 and the sleeve 142. The sleeve 142 is positionally fixed relative to the rear guide tube 138. Accordingly, the sleeve 142 is stationary with the rear guide tube 138 relative to the movement of the power spring 128 between the compressed position and the uncompressed position. The sleeve 421 includes an inner diameter that is slightly larger than an outer diameter of the power spring 128 when the power spring 128 is in the compressed position. Accordingly, when the power spring 128 moves from the compressed position to the uncompressed position upon firing the air gun, the power spring 128 contracts radially away from the inner diameter of the sleeve 142, thereby minimizing friction between the power spring 128 and the sleeve 142 during movement of the power spring 128 when fired.

The sleeve 142 includes a sleeve length 148 that extends along the longitudinal axis 134. Preferably, the sleeve length 148 is at least equal to or greater than one half the uncompressed spring length 132. The center of the power spring 128 as measured along the longitudinal axis 134 is the least laterally stable point of the power spring 128. Accordingly, by ensuring the sleeve 142 extends beyond the center of the power spring 128, the dampening system 130 maximizes resistance to radial vibration and/or oscillation of the power spring 128 during movement of the power spring 128, thereby dampening the power spring assembly 120.

The rear guide tube 138 includes a ridge 150, which extends radially outward from a rearward end of the rear guide tube 138. The ridge 150 engages the sleeve 142, and prevents axial movement of the sleeve 142 past the rearward end of the rear guide tube 138 along the longitudinal axis 134. Accordingly, the ridge 150 cooperates with the sleeve 142 to restrict movement of the sleeve 142 in at least one direction along the longitudinal axis 134.

A rearward end of the power spring 128 is disposed within the annular gap 146 defined between the rear guide tube 138 and the sleeve 142. The rear guide tube 138 and the sleeve 142 cooperate to radially support a portion of the power spring 128 disposed within the annular gap 146. Supporting the portion of the power spring 128 within the annular gap 146 limits radial movement of the power spring 128, e.g., oscillation, along the portion of the power spring 128 disposed within the annular gap 146 to reduce vibration of the power spring 128 when moved from the compressed position into the uncompressed position. As such, when the air gun is fired and the power spring 128 rapidly decompresses and moves from the compressed position into the uncompressed position, the power spring 128 expands along the longitudinal axis 134. In addition to expansion along the longitudinal axis 134, the power spring 128 expands radially, causing oscillation of the power spring 128 radially about the longitudinal axis 134. However, because the rear guide tube 138 is disposed within the hollow core 136 of the power spring 128, and the sleeve 142 is disposed about an outer diameter of the power spring 128, the radially oscillation of the power spring 128, is limited, thereby reducing vibration of the power spring 128.

The dampening system 130 may further include an energy absorbing device 152. As shown, the energy absorbing device 152 is disposed adjacent the rearward end of the power spring 128, and is configured for absorbing vibration from the power spring 128 when the power spring 128 moves from the compressed position into the uncompressed position when fired. As such, the energy absorbing device 152 absorbs vibration directed axially along the longitudinal axis 134, either from the power spring 128 directly or through the sleeve 142 and/or the rear guide tube 138. The dampening system 130 may further include a bushing 154 disposed between the energy absorbing device 152 and the rearward end of the power spring 128. The bushing 154 may include, but is not limited to, a washer or the like. The bushing 154 prevents and/or limits torque transmission between the power spring 128 and the energy absorbing device 152 or the sleeve 142.

As shown, the energy absorbing device 152 includes an annular ring manufactured form a dampening material. The annular ring is disposed within the annular gap 146 defined by the rear guide tube 138 and the sleeve 142, i.e., the annular ring is disposed about the rear guide tube 138, within the bore 144 defined by the sleeve 142. Additionally, the annular ring is disposed between the ridge 150 of the rear guide tube 138 and the rearward end of the power spring 128. Preferably, the dampening material includes a visco-elastic polymer. A visco-elastic polymer is a material that exhibits properties of both a liquid material (viscous solutions) and a solid material (elastic materials). More preferably, the dampening material includes Sorbothane®. Sorbothane® is a registered trademark of Sorbothane, Inc. Sorbothane® is a thermoset, polyether-based, polyurethane material that is particularly well suited for use in the energy absorbing device 152. However, it should be appreciated that the visco-elastic polymer may include a product other than Sorbothane®. Additionally, it should be appreciated that the dampening material may include some other material. For example, the dampening material may include, but is not limited to, a gel, a grease, an elastomeric material, or some other material capable of absorbing vibration.

The size and/or length of the energy absorption device 152 along the longitudinal axis 134 may be varied to modify the spring force provided by the power spring assembly 120. As such, it should be appreciated that increasing the length of the energy absorption device 1582 along the longitudinal axis 134 reduces the compressed spring length of the power spring 128, thereby increasing the force generated by the power spring assembly 120. Similarly, decreasing the length of the energy absorption device 152 along the longitudinal axis 134 increases the compressed spring length of the power spring 128, thereby decreasing the force generated by the power spring assembly 120.

As shown, the rear guide tube 138 includes a circumferential recess 156, which extends radially inward from the outer surface of the rear guide tube 138. The energy absorbing device 152, i.e., the annular ring, is set in and longitudinally positioned along the longitudinal axis 134 by the circumferential recess 156. Accordingly, because the energy absorbing device 152 is set in the circumferential recess 156, the energy absorbing device 152 is restricted from movement relative to the rear guide tube 138. Preferably, the annular ring includes an outer diameter that is substantially equal to a diameter of the bore 144 defined by the sleeve 142, thereby providing a snug fit between the sleeve 142 and the annular ring. The snug fit between the sleeve 142 and the ring resists movement of the sleeve 142 relative to the annular ring, thereby coupling the sleeve 142 to the rear guide tube 138. Additionally, the sleeve 142 may include a ledge 158 disposed within the bore 144 of the sleeve 142, and configured for securing the energy absorbing device 152 within the sleeve 142. The ledge 158 extends radially inward toward the longitudinal axis 134, with the energy absorbing device 152 disposed between the ridge 150 of the rear guide tube 138 and the ledge 158. The ledge 158 may include any suitable size and or shape capable of retaining the energy absorption device 152 in place. It should be appreciated that the ledge 158 may be omitted from the sleeve 142 as well.

The dampening system 130 may further include a compression ring 162. The compression ring 162 is disposed radially between the sleeve 142 and the energy absorbing device 152. The compression ring 162 is sized to slideably fit within the bore 144 of the sleeve 142. The compression ring 162 includes a length along the longitudinal axis 134 substantially equal to or slightly less than the length of the energy absorption device 152. It should be appreciated that the compression ring 162 may be omitted from the dampening system 130 as well.

The dampening system 130 may further include a forward guide tube 160. The forward guide tube 160 is at least partially disposed within the hollow core 136 of the power spring 128, adjacent a forward end of the power spring 128. The forward guide tube 160 operates as described above in other embodiments to support an inner diameter of the power spring 128 during movement of the power spring 128.

Preferably, the rear guide tube 138, the forward guide tube 160, the sleeve 142 and/or the compression ring 162 include and are manufactured from a vibration dampening material. The vibration dampening material preferably includes a durometer of between 40 and 70 dur. The vibration dampening material may include, but is not limited to, a urethane material, a polymer material or a plastic material. Alternatively, the rear guide tube 138, the forward guide tube 160, the sleeve 142 and the compression ring 162 may include and be manufactured from a rigid material, such as, but not limited to, steel.

During compression of the power spring 128 into the compressed position, the power spring 128 expands radially into contact with the sleeve 142, with the sleeve 142 restraining the power spring 128 from canting, i.e., bending out of longitudinal alignment along the longitudinal axis 134, thereby positioning the power spring 128 in an axial position aligned along the longitudinal axis 134. When the air gun is fired, the power spring 128 contracts radially as it expands axially along the longitudinal axis 134. Because the power spring 128 contracts radial away from the sleeve 142, and because the rear guide tube 138 is sized so as to not interfere with the power spring 128, the power spring 128 is free to expend all of its energy along the longitudinal axis 134 to propel the projectile, and does not need to overcome any fiction between the rear guide tube 138 and the power spring 128, or any friction between the sleeve 142 and the power spring 128. Furthermore, the rear guide tube 138 cooperates with the sleeve 142 to prevent the power spring 128 form canting during movement, to ensure all of the stored energy of the power spring 128 is directed axially along the longitudinal axis 134, and to minimize oscillation of the power spring 128 when fired. Additionally, the energy absorbing device 152 absorbs the shock and vibration generated from the power spring 128 when fired. Accordingly, the dampening system 130 minimizes the vibration and spring twang typically found in spring loaded air guns.

The invention has been described in an illustrative manner, and it is to be understood that the terminology, which has been used, is intended to be in the nature of words of description rather than of limitation. It is to be understood that the invention is not limited to the exact construction or method which has been illustrated and discussed above, but that various changes and modifications may be made without departing from the spirit and the scope of the invention. While the best modes for carrying out the invention have been described in detail, those familiar with the art to which this invention relates will recognize various alternative designs and embodiments for practicing the invention within the scope of the appended claims.

The invention claimed is:

1. A charging assembly for an air gun having a compression tube, the charging assembly comprising:

a piston having a head and a skirt extending from the head along a longitudinal axis, wherein the piston is disposed within and supported by the compression tube and slideably moveable within the compression tube between a rearward position and a forward position;

a power spring at least partially disposed within the skirt of the piston, wherein the power spring is moveable from a compressed position to an uncompressed position to move the piston from the rearward position into the forward position;

wherein the power spring extends along the longitudinal axis and defines a hollow core; and a dampening system including:

a rear guide tube disposed within the hollow core of the power spring and operable to radially support an inner diameter of the power spring when the power spring is disposed in the uncompressed position; and a sleeve disposed between an inner diameter of the skirt and an outer diameter of the power spring, and defining a bore, wherein the sleeve is coupled to and at least partially surrounds the rear guide tube with the rear guide tube and the power spring disposed within the bore, wherein the sleeve is operable to contact and radially support the outer diameter of the power spring when the power spring is disposed in the compressed position;

wherein the sleeve and the rear guide tube cooperate to reduce a length of the power spring which is free to oscillate during the movement of the power spring from the compressed position into the uncompressed position to limit vibration of the power spring when fired.

2. A charging assembly as set forth in claim 1 further comprising an energy absorbing device disposed between said rear guide tube and said sleeve and configured for absorbing vibration from the power spring.

3. A charging assembly as set forth in claim 2 further comprising a bushing disposed adjacent said energy absorbing device and engaging a rearward end of the power spring.

4. A charging assembly as set forth in claim 2 wherein said sleeve is attached to said rear guide tube, with said sleeve and said rear guide tube stationary relative to each other and stationary during movement of the power spring.

5. A charging assembly as set forth in claim 2 further comprising a compression ring disposed radially about an outer periphery of said energy absorbing device, between said energy absorbing device and said sleeve.

* * * * *